US005910279A

United States Patent [19]

Yanai et al.

[11] Patent Number: 5,910,279

[45] Date of Patent: Jun. 8, 1999

[54] METHOD FOR FORMING DURABLE CREASES IN CELLULOSIC FIBER TEXTILE

[75] Inventors: Yuichi Yanai; Takayuki Hirai; Masayoshi Oba; Kiyoshi Ikeda; Yasushi Takagi; Takeo Ishikawa; Kazuhiko Harada; Hirotaka Iida; Kazuhiko Arakawa, all of Okazaki; Masazumi Ii; Yuzo Nakamura, both of Hamamatsu, all of Japan

[73] Assignee: Nisshinbo Industries, Inc., Tokyo, Japan

[21] Appl. No.: 08/840,130

[22] Filed: Apr. 11, 1997

[30] Foreign Application Priority Data

| | | | |
|---|---|---|---|
| Apr. 12, 1996 | [JP] | Japan | 8-114399 |
| Jul. 25, 1996 | [JP] | Japan | 8-214201 |
| Dec. 3, 1996 | [JP] | Japan | 8-336269 |
| Jan. 20, 1997 | [JP] | Japan | 9-021007 |
| Mar. 7, 1997 | [JP] | Japan | 9-070638 |

[51] Int. Cl.[6] ..... B31F 1/12

[52] U.S. Cl. ..... 264/282; 264/285; 264/339; 8/125

[58] Field of Search ..... 264/282, 285, 264/339; 8/125

[56] References Cited

U.S. PATENT DOCUMENTS

| | | | |
|---|---|---|---|
| 1,512,285 | 5/1970 | Pensa . | |
| 3,511,591 | 5/1970 | Webb | 8/116 |
| 3,663,159 | 5/1972 | Gordon . | |
| 3,664,158 | 5/1972 | Skaathun et al. | 68/5 D |
| 3,915,632 | 10/1975 | Troope et al. | 8/125 |

FOREIGN PATENT DOCUMENTS 1372445 10/1974 United Kingdom .

OTHER PUBLICATIONS

Melliand Textilberichte, vol. 59, No. 8, Heidelberg, pp. 648–652, XP002039577, Karl Bredereck: "Fixierung von Baumwollgeweben durch NaOH–Mercerisation und Flüssigammonika–Behandlung" Aug. 1978.

Textile Research Journal, vol. 53, No. 9, Princeton, USA, pp. 557–566, XP002039675, Mastura Raheel: "Modifying Wear Life of All–Cotton Fabrics" Sep. 1983.

*Primary Examiner*—Christopher Raimund
*Attorney, Agent, or Firm*—Birch, Stewart, Kolasch & Birch, LLP

[57] ABSTRACT

Creases are formed in a cellulosic fiber textile by treating the fiber textile with liquid ammonia, creasing the fiber textile, and treating the fiber textile with hot water or alkaline solution substantially simultaneous with or subsequent to the creasing step. Fully durable creases are formed in the cellulosic fiber textile without detracting from strength.

7 Claims, 3 Drawing Sheets

METHOD FOR FORMING DURABLE CREASES IN CELLULOSIC FIBER TEXTILE

BACKGROUND OF THE INVENTION

1. Field of the Invention

This invention relates to a method for forming durable creases in a cellulosic fiber textile. By the term "creasing" or "crease formation" used herein it is meant that fabric generally having a flat surface is given a surface change in the form of creases or wrinkles consisting of ridges and furrows. The term is used to encompass pleating.

2. Prior Art

A number of methods are known for creasing cellulosic fiber textiles. For example, JP-B 5867/1981 and 39548/1984 propose a creasing method using a special creasing machine. Undesirably, the thus formed creases are temporary and less durable to washing.

Also known is a method of impregnating a cellulosic fiber textile with a cellulose-reactive resin, creasing the impregnated textile by means of a creasing machine and heat treating the textile for setting creases or pleating the impregnated textile and heating it for setting pleats. This method has the drawbacks that formaldehyde is often left in the textile and the resultant creases or pleats are reduced in strength and less durable to washing.

One known method for improving the durability to washing of creases is by charging a boiling or scouring kier with creased cellulosic fiber textiles to a volume of about 10% of the entire volume, placing fabric pieces thereon, and effecting scouring in a conventional manner. However, the thus treated creases are still less durable to washing and the textile becomes harder in hand and feel.

SUMMARY OF THE INVENTION

An object of the present invention is to provide a novel and improved method for forming durable creases in a cellulosic fiber textile at no sacrifice of strength.

According to the present invention, durable creases are formed in a cellulosic fiber textile by the steps of treating the fiber textile with liquid ammonia, creasing the fiber textile, and treating the fiber textile with hot water or alkaline solution substantially simultaneous with or subsequent to the creasing step.

More particularly, a cellulosic fiber textile is treated with liquid ammonia for converting at least part of a cellulose I or II crystalline structure in the cellulosic fiber textile into a cellulose III crystalline structure. The cellulosic fiber textile having such cellulose III crystalline structure is subjected to (1) hot water treatment at 100 to 150° C. for 10 minutes to 5 hours substantially simultaneous with or subsequent to creasing, (2) hot alkali treatment in an aqueous solution having an alkali concentration of 0.1 to 10% by weight at 100 to 150° C. for 10 minutes to 5 hours substantially simultaneous with or subsequent to creasing, or (3) cold alkali treatment in an aqueous solution having an alkali concentration of 10 to 40% by weight at −10° C. to 90° C. for at least 20 seconds substantially simultaneous with or subsequent to creasing By the liquid ammonia treatment, the fibers are swollen and the cellulose III crystalline structure is created at the same time. While the fibers are maintained swollen, creasing is carried out before the cellulose III is converted back to cellulose I or II crystalline structure. Hot water or alkali treatment is carried out substantially simultaneous with or subsequent to creasing, allowing the cellulose III to resume the more stable cellulose I or II crystalline structure. The initial creases are maintained even after washing and last for a long term. The creases are significantly durable against washing.

DETAILED DESCRIPTION OF THE INVENTION

Figure 1:
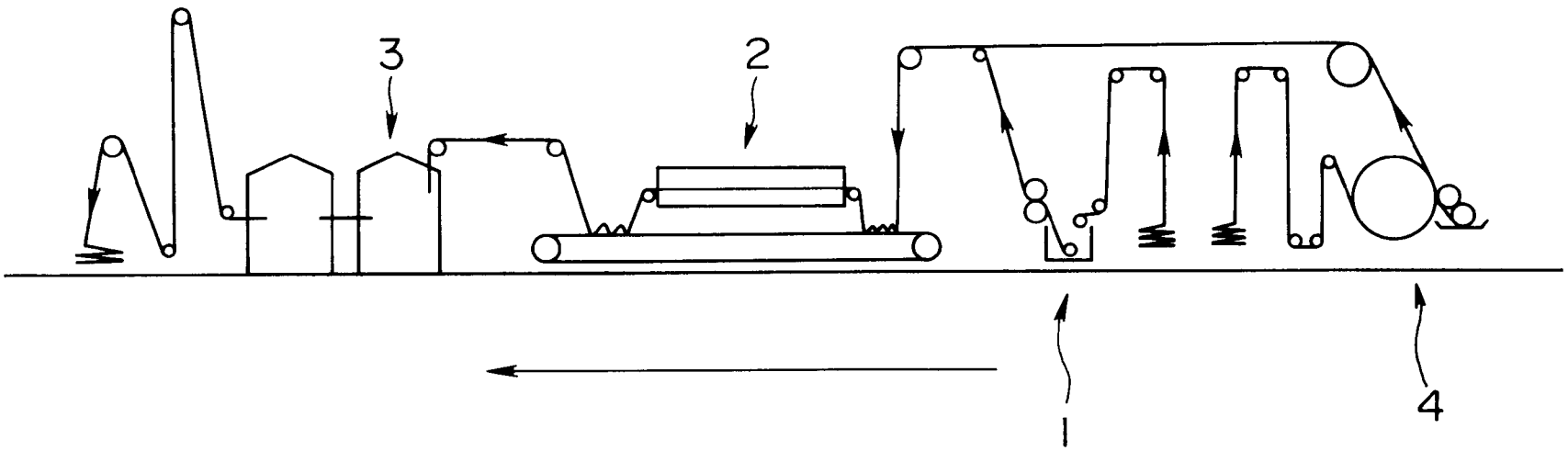
FIG. 1 is a schematic view showing an overall processing system of cold alkali treatment including a caustic soda solution applicator, a creasing machine, and a neutralizing/washing machine.

The method for forming durable creases in a cellulosic fiber textile according to the invention involves the steps of treating the fiber textile with liquid ammonia, creasing the fiber textile, and subjecting the fiber textile to hot water treatment or alkali treatment, typically hot water treatment (1), hot alkali treatment (2) or cold alkali treatment (3) as mentioned above, substantially simultaneous with or subsequent to the creasing step.

The cellulosic fiber textile which can be processed by the method of the invention is composed of cellulosic fibers. The cellulosic fibers which can be used herein include cotton, hemp, rayon, polynosics, cuprammonium fibers, and Tencel. These fibers may take the form of composite fibrous materials which are blended, twisted or united with other fibers such as synthetic fibers, typically polyester fibers. The composite fibrous materials should preferably have a greater content of cellulosic fibers, more preferably a cellulosic fiber content of at least 50% by weight. The alkali treatment can be applied only to fibers which are insoluble in the alkali solution to be used.

The cellulosic fiber textile which can be used herein includes woven fabrics, knitted goods and non-woven fabrics. If desired, the textile may be subjected to pretreatment such as singeing, scouring, bleaching, and mercerizing.

First, the cellulosic fiber textile is treated with liquid ammonia, for example, by impregnating the textile with liquid ammonia kept at a temperature of −33° C. or lower. The impregnating means include dipping in liquid ammonia, spraying of liquid ammonia, and coating of liquid ammonia. The impregnating time may be properly selected although it is generally about 5 to 80 seconds, preferably about 10 to 60 seconds. Liquid ammonia is most often used to induce transition of cellulose I or II in the cellulosic fiber textile into cellulose III although lower alkylamines such as methylamine and ethylamine may be used if desired.

The liquid ammonia treatment of cellulosic fiber textile is described in more detail. Native cellulose in the cellulosic fiber textile generally assumes a cellulose I crystalline structure. When fiber textile assuming cellulose I is mercerized (or treated with caustic alkali), the crystalline structure is converted into a cellulose II crystalline structure. Regenerated cellulose has a cellulose II crystalline structure from the first. When fiber textile assuming a cellulose I or II crystalline structure is subjected to impregnating treatment with liquid ammonia, liquid ammonia penetrates into not only amorphous regions, but also crystalline regions of cellulose fibers to break hydrogen bonds so that the textile in its entirety is fully swollen. Thereafter, heat treatment is carried out to evaporate off liquid ammonia whereupon hydrogen bonds are newly formed and a cellulose III crystalline structure is created at least partially in the crystalline region. Crystals are fixed in a swollen state.

After ammonia is removed from the liquid ammonia-treated cellulosic fiber textile by heating, the fiber textile is subjected to either one of (1) hot water treatment, (2) hot alkali treatment and (3) cold alkali treatment substantially simultaneous with or subsequent to crease formation.

The step of forming creases or pleats in the cellulosic fiber textile may be carried out by means of a creasing or pleating machine, or by various techniques, such as by crumpling with hands, forcibly pushing the textile into a bag, box, tube and other container, and gathering and tying the textile with thread as in tie dyeing. The creasing or pleating machine which can be used herein is not critical and may be selected from those described in JP-B 8920/1977, 5867/1981, 39548/1984, and 201573/1989, for example. The pleating step, when used herein, may be done as in the prior art, but without applying cellulose-reactive resin.

Hot water treatment (1) is carried out substantially simultaneous with or subsequent to creasing. The hot water treatment is carried out by dipping the cellulosic fiber textile in hot water at a temperature of 100 to 150° C., preferably 110 to 140° C. More particularly, an apparatus capable of hot water treatment under high pressure while maintaining creases or pleats in a desired state is used. For example, hot water treatment is carried out by using a high-pressure container which is originally used in another application, as found in high-pressure cheese dyeing machines, high-pressure beam dyeing machines, and high-pressure liquid flow dyeing machines, and providing the container with a suitable jig or means for applying a weight. By introducing the creased or pleated cellulosic fiber textile into such an apparatus, hot water treatment can be automatically carried out.

The time of hot water treatment varies with the temperature of hot water, the content of cellulose III prior to the treatment, and the percent transition of cellulose I and/or II into cellulose III. In general, the treating time is about 10 minutes to about 5 hours, preferably about 20 minutes to about 4 hours.

By the hot water treatment, at least part of cellulose III in the cellulosic fiber textile is converted back to cellulose I and/or II. When the process starts from the cellulose I crystalline structure, the textile resumes the same as a result of hot water treatment. When the process starts from the cellulose II crystalline structure, the textile resumes the same as a result of hot water treatment.

Since the hot water treatment is applicable to dyed and printed textiles without detracting from color fastness, the cellulosic fiber textile may be dyed or printed prior to hot water treatment.

Hot alkali treatment (2) is carried out substantially simultaneous with or subsequent to creasing. The alkali used herein is typically sodium hydroxide (NaOH) or potassium hydroxide (KOH). The alkali is dissolved in water to form an aqueous solution preferably having an alkali concentration of 0.1 to 10.0% by weight, more preferably 0.2 to 5.0% by weight.

Hot alkali treatment is generally carried out by dipping the cellulosic fiber textile in an alkaline solution at a temperature of 100 to 150° C., preferably 110 to 140° C. More particularly, an apparatus capable of hot alkali treatment under high pressure while maintaining creases or pleats in a desired state is used. For example, hot alkali treatment is carried out by using a high-pressure container which is originally used in another application, as found in high-pressure cheese dyeing machines, high-pressure beam dyeing machines, and high-pressure liquid flow dyeing machines, and providing the container with a suitable jig or means for applying a weight. By introducing the creased or pleated cellulosic fiber textile into such an apparatus, hot alkali treatment can be automatically carried out.

The time of hot alkali treatment cannot be definitely determined since it varies with the temperature of alkaline solution and other factors. In general, the treating time is about 10 minutes to about 5 hours, preferably about 20 minutes to about 3 hours.

By the hot alkali treatment, at least part of cellulose III which has been created in the cellulosic fiber textile by the liquid ammonia treatment is converted back to more stable cellulose II while maintaining the swollen state. Durable creases are established in this way.

The thus hot alkali treated cellulosic fiber textile is then treated with an acid for neutralizing the alkali and washed with water. The acid used herein includes inorganic acids such as sulfuric acid and hydrochloric acid and organic acids such as acetic acid and formic acid.

Cold alkali treatment (3) is carried out substantially simultaneous with or subsequent to creasing. More specifically, an alkaline solution is applied to a part or the entirety of the liquid ammonia-treated cellulosic fiber textile while the textile is creased. The cold alkali treatment is followed by neutralization and water washing. The cold alkali treatment is generally carried out at a temperature of −10° C. to 90° C. For ease of operation, the cold alkali treatment is preferably carried out at 10 to 40°C.

The alkaline solution used herein is typically an aqueous solution of sodium hydroxide (NaOH) or potassium hydroxide (KOH). Other alkaline chemicals may be used if desired. The alkali is dissolved in water to form an aqueous solution preferably having an alkali concentration of 10 to 40% by weight, more preferably 15 to 30% by weight.

The alkaline solution may be applied to the entire surface of the cellulosic fiber textile or locally to areas of the textile where creases are to be formed. The amount of the alkaline solution applied to the cellulosic fiber textile is preferably at least 50% by weight of the applied textile portion.

A mangle padder may be used where the alkaline solution is applied to the entire surface of the cellulosic fiber textile. For local application of alkaline solution to selected portions, a printing machine as used for the printing purpose may be used. If desired, the cellulosic fiber textile may be dyed or printed prior to application of alkaline solution, that is, cold alkali treatment.

As mentioned previously, cold alkali treatment (3) is carried out substantially simultaneous with or subsequent to creasing. It is preferred to carry out creasing substantially simultaneous with application of alkaline solution. Differently stated, it is preferred to carry out cold alkali treatment simultaneous with or immediately before creasing. The term "substantially simultaneous" means that creasing is carried out within 60 seconds, preferably within 40 seconds, more preferably within 30 seconds after application of alkaline solution. If creasing is carried out after a certain time delay from the application of alkaline solution, formation of fully durable creases would be difficult because cellulose III in the cellulosic fiber textile has been substantially converted back to cellulose II by virtue of the alkaline solution.

The time of cold alkali treatment is not particularly limited although the treating time is generally at least about 20 seconds and typically the same as in the case of hot alkali treatment (2).

The thus alkali treated cellulosic fiber textile is then treated with an acid for neutralizing the alkali and washed with water. If creasing is immediately followed by neutralizing/washing treatment, cellulose III in the cellulosic fiber textile is not converted to cellulose II and consequently, the creases are not fully fixed. It is thus recommended to carry out neutralizing/washing treatment after the lapse of some time from the creasing step. Differently stated, it is preferred to carry out neutralization after at least a part of cellulose III in the cellulosic fiber textile has been converted into cellulose II. Specifically, neutralization is desirably carried out after at least 20 seconds, more desirably at least 60 seconds from the end of creasing step.

Figure 2:
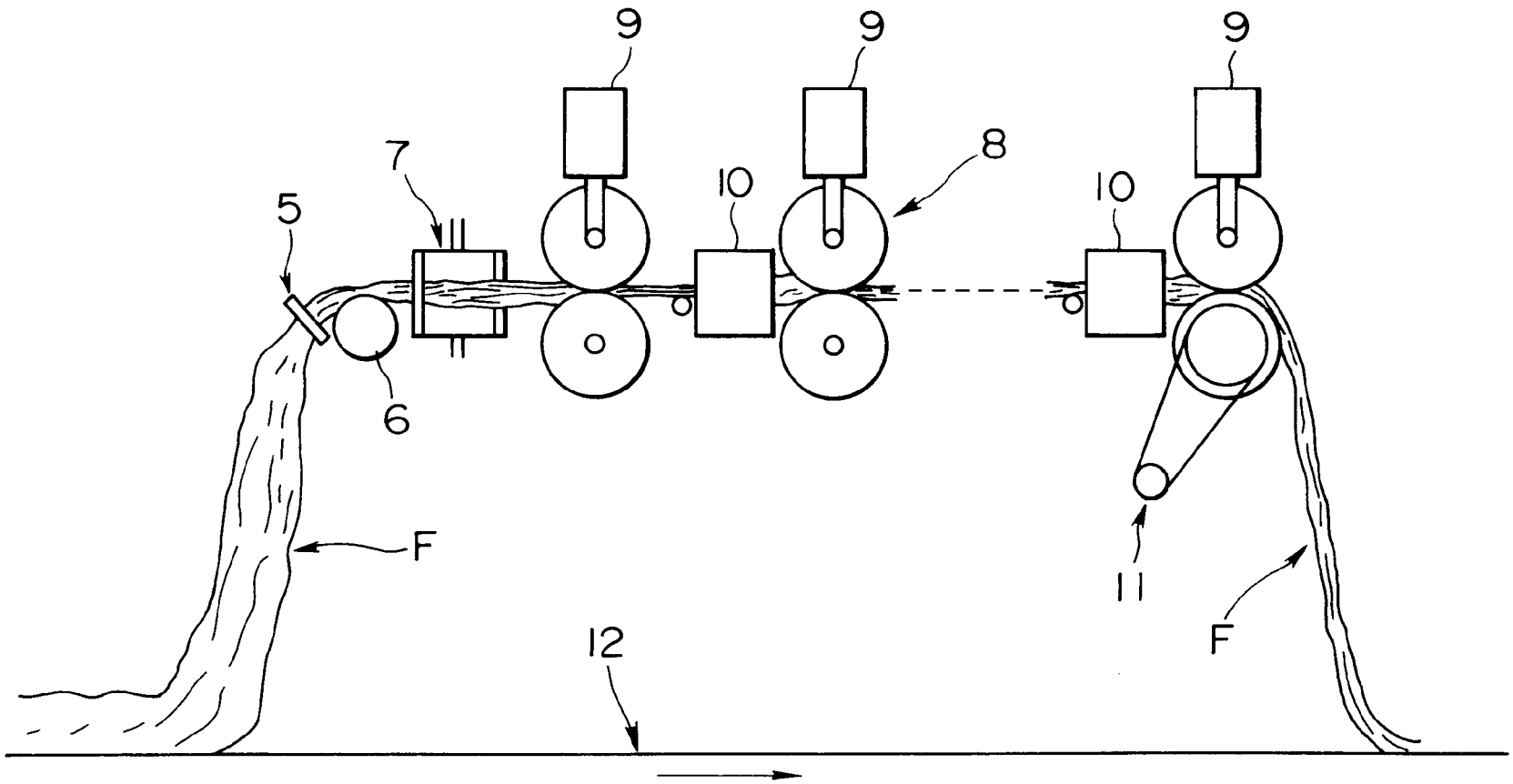
FIG. 2 is a schematic view of the creasing machine of the system.
Figure 3:
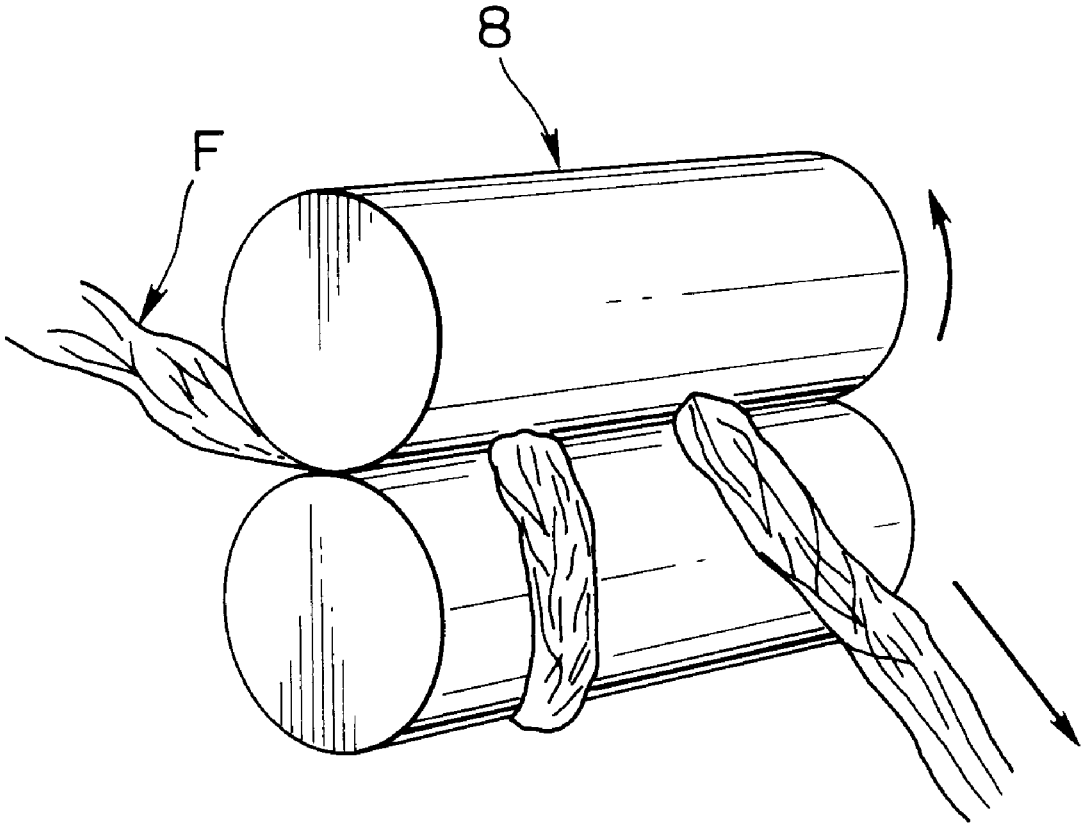
FIG. 3 illustrates a rope of gathered fabric being passed around rubber rollers of the creasing machine.

The above-mentioned cold alkali treatment may be carried out using a processing system as shown in FIGS. 1 to 3. With this system, application of caustic soda solution, creasing, and neutralizing/washing treatment can be continuously carried out.

FIG. 1 schematically illustrates a processing system including a mangle padder and a neutralizing/washing machine as well as a creasing machine. More particularly, the system includes a printing machine 4, a mangle padder 1 for applying an aqueous solution of caustic soda, a creasing machine 2, and a neutralizing/washing machine 3 for neutralizing the caustic soda and water washing, serially arranged to define a path that a cellulosic fiber textile travels. FIGS. 2 and 3 illustrates in enlarged views the creasing machine including a ring 5, a guide roll 6, a swivel tension bar 7, rubber rollers 8, pneumatic cylinders 9, guide panels 10, a drive motor 11, and a conveyor 12.

Using the system, cold alkali treatment is carried out on cellulosic fiber textile as follows. An aqueous caustic soda solution of a predetermined concentration and temperature is applied to the textile by means of the mangle padder 1 The textile F is conveyed to the creasing machine 2 where the textile F is passed through the ring 5 for gathering and bundling the textile into a rope and through the swivel tension bar 7 for imparting an appropriate tension. The rope of textile is guided to a roller section including six pairs of opposed rubber rollers 8. For each pair, the pneumatic cylinder 9 applies a force to place the rubber rollers 8 under pressure contact for compressing the rope of textile F therebetween. As shown in FIG. 3, the textile F is once compressed between the rubber rollers 8, passed one round around the lower rubber roller 8, and compressed again between the rollers 8 whereby numerous longitudinal creases are imparted to the textile. The creasy textile is introduced into the neutralizing/washing machine 3 after a predetermined delay time from the end of creasing step. The textile is then washed with water and dried.

With this system, application of caustic soda solution, creasing, and neutralizing/washing treatment can be continuously carried out in high yields.

There has been described a method capable of forming durable creases or pleats in a cellulosic fiber textile The creases or pleats withstand repetitive washing. The inventive method is effective for forming creases or pleats which will last long without post-treatment with a cellulose-reactive resin. Because of elimination of such post-treatment, creases or pleats do not undergo a loss of strength.

After crease formation according to the invention, the cellulosic fiber textile may be subjected to final finishing treatment such as tentering and feel to the touch adjustment.

EXAMPLE

Examples of the present invention are given below by way of illustration and not by way of limitation.

Examples 1–11 & Comparative Examples 1–2

A woven fabric of 50-count single yarn cotton broadcloth (warp density 148 yarns/inch, weft density 80 yarns/inch) was conventionally bleached, dipped in liquid ammonia at a temperature of −34° C. as shown in Table 1, and conventionally heated for evaporating off ammonia.

The fabric was then crumpled with hands for creasing such that crushed acute angle creases were distributed throughout the fabric. The creased fabric was treated with hot water by means of a high-pressure cheese dyeing machine, followed by dewatering, drying, and tentering. In Examples 10 and 11, the fabric was dyed and printed prior to creasing, respectively Comparative Example 1 omitted the liquid ammonia treatment. Comparative Example 2 carried out mercerization instead of the liquid ammonia treatment. It is noted that the dipping time in liquid ammonia, the temperature and time of hot water treatment in each of Examples and Comparative Examples are as shown in Table 1.

The finished fabrics were subjected to a washing test (JIS L-217 103 method) involving 10 cycles of washing. The fabrics were visually observed to examine whether creases were maintained, with rating made according to the following criterion. The results are shown in Table 1.

TABLE 1

| | Liquid ammonia | Hot water treatment | | Creasing | |
|---|---|---|---|---|---|
| | dipping time (sec.) | Temp. (° C.) | Time (min.) | before washing | 10 cycles of washing |
| Example 1 | 10 | 100 | 120 | 6 | 4 |
| Example 2 | 10 | 110 | 60 | 6 | 4 |
| Example 3 | 10 | 130 | 20 | 6 | 4 |
| Example 4 | 10 | 130 | 30 | 6 | 4 |
| Example 5 | 10 | 130 | 60 | 6 | 5 |
| Example 6 | 10 | 130 | 120 | 6 | 5 |
| Example 7 | 10 | 130 | 240 | 6 | 5 |
| Example 8 | 20 | 130 | 240 | 6 | 5 |
| Example 9 | 60 | 130 | 90 | 6 | 5 |
| Example 10 | 10 | 130 | 90 | 6 | 5 |
| Example 11 | 10 | 130 | 90 | 6 | 5 |
| Comparative Example 1 | 0 | 130 | 240 | 6 | 1 |
| Comparative Example 2 | 0 | 130 | 240 | 6 | 1 |

Crease rating
6: after washing, acute creases are maintained substantially the same as before washing
5: after washing, creases are maintained acute, but somewhat less acute than 6
4: after washing, creases are maintained, but less acute than 5
3: after washing, creases are maintained, but less acute than 4
2: after washing, dull creases are left
1: after washing, few creases are left In Examples 10 and 11, the dyed and printed fabrics were determined for color fastness before and after the hot water treatment. The results are shown in Table 2.

TABLE 2

| Color fastness | | Example 10 (dyed) Before hot water treatment | Example 10 (dyed) After hot water treatment | Example 11 (printed) Before hot water treatment | Example 11 (printed) After hot water treatment | Remarks |
|---|---|---|---|---|---|---|
| Washing | Fading | 4–5 | 4–5 | 4–5 | 4–5 | JIS L 844 |
| | Staining | 5 | 5 | 5 | 5 | A-2 |
| Sweat | Fading | 4–5 | 4–5 | 4–5 | 4–5 | JIS L 848 |
| | Staining | 5 | 5 | 5 | 5 | A |
| Light | Fading | ≧4 | ≧4 | ≧4 | ≧4 | JIS L 842 |
| Sweat + light | Fading | 4–5 | 4–5 | 4–5 | 4–5 | JIS L 888 |
| Rubbing | Dry | 5 | 5 | 5 | 5 | JIS L 849 |
| | Wet | 4 | 4 | 4 | 4 | II |

Example 12 & Comparative Examples 3–4

A woven fabric of 50-count single yarn cotton broadcloth (warp density 148 yarns/inch, weft density 80 yarns/inch) was conventionally bleached, dipped in liquid ammonia at a temperature of −34° C. for 10 seconds, and heated for evaporating off ammonia.

The fabric was gathered and tied with thread and subjected to hot water treatment at 130° C. for 120 minutes in a high-pressure cheese dyeing machine. The fabric was dewatered, dried, tie dyed with a reactive dye in a conventional manner, dried, and loosened by removing the tying thread.

Comparative Example 3 omitted the hot water treatment from Example 12. Comparative Example 4 omitted the liquid ammonia treatment and hot water treatment from Example 12.

Example 13 & Comparative Examples 5–6

Example 12 was repeated except that a single tuck knitted fabric of 40-count two-folded yarn (30 inches×18 G) was used instead of the woven fabric of 50-count single yarn cotton broadcloth.

Comparative Example 5 omitted the hot water treatment from Example 13. Comparative Example 6 omitted the liquid ammonia treatment and hot water treatment from Example 13.

Example 14 & Comparative Examples 7–8

Example 12 was repeated except that a plain knitted fabric of 30-count single yarn (30 inches×28 G) was used instead of the woven fabric of 50-count single yarn cotton broadcloth.

Comparative Example 7 omitted the hot water treatment from Example 14. Comparative Example 8 omitted the liquid ammonia treatment and hot water treatment from Example 14.

The fabrics obtained in Examples 12 to 14 and Comparative Examples 3 to 8 were subjected to a washing test (JIS L-217 103 method) involving 20 cycles of washing. The fabrics were visually observed to examine whether creases were maintained, with rating made according to the same criterion as in Example 1. The results are shown in Table 3.

TABLE 3

| | Creasing | | |
|---|---|---|---|
| | Before washing | 10 cycles of washing | 20 cycles of washing |
| Example 12 | 6 | 5 | 5 |
| Comparative Example 3 | 6 | 4 | 3 |
| Comparative Example 4 | 6 | 1 | 1 |
| Example 13 | 6 | 5 | 5 |
| Comparative Example 5 | 6 | 4 | 3 |
| Comparative Example 6 | 6 | 1 | 1 |
| Example 14 | 6 | 5 | 5 |
| Comparative Example 7 | 6 | 4 | 3 |
| Comparative Example 8 | 6 | 1 | 1 |

Examples 15–17 & Comparative Examples 9–11

A woven fabric of 80-count two-folded yarn cotton broadcloth (warp density 128 yarns/inch, weft density 68 yarns/inch) was conventionally bleached, dipped in liquid ammonia at a temperature of −34° C., pleated, and treated with hot water. It is noted that the dipping time in liquid ammonia, the temperature and time of hot water treatment in each of Examples and Comparative Examples are as shown in Table 4.

The finished fabrics were subjected to a washing test (JIS L-217 103 method) involving 10 cycles of washing. The fabrics were visually observed to examine the retention of pleats before washing and after 1 and 10 cycles of washing, with rating made according to the following criterion. The results are shown in Table 4.

TABLE 4

| | | E15 | E16 | E17 | CE9 | CE10 | CE11 |
|---|---|---|---|---|---|---|---|
| Liquid ammonia dipping time (sec.) | | 10 | 10 | 10 | 0 | 0 | 0 |
| Hot water treatment | Temp. (° C.) | 100 | 110 | 130 | 100 | 110 | 130 |
| | Time (min.) | 120 | 60 | 20 | 120 | 60 | 20 |
| Pleat rating | Before washing | ○ | ○ | ○ | ○ | ○ | ○ |
| | 1 cycle of washing | ○ | ○ | ○ | Δ or X | X | Δ or X |
| | 10 cycles of washing | ○ | ○ | ○ | X | X | X |

Pleat rating
○: pleats are well retained
Δ: some pleats are left
X: no pleats are left Example 18

A woven fabric of 50-count single yarn cotton broadcloth (warp density 148 yarns/inch, weft density 80 yarns/inch) was conventionally bleached, dipped in liquid ammonia at a temperature of −34° C. for 10 seconds, and conventionally heated for evaporating off ammonia.

The fabric was then crumpled with hands for creasing such that crushed acute angle creases were distributed throughout the fabric. The creased fabric was subjected to hot alkali treatment by means of a high-pressure cheese dyeing machine, followed by neutralization, dewatering, drying, and tentering.

The hot alkali treatment was carried out at 130° C. for 30 minutes using aqueous solutions of sodium hydroxide in a concentration of 0.2%, 1.0% and 5.0% by weight.

Example 19

Example 18 was repeated except that hot alkali treatment was carried out at 130° C. for 60 minutes using aqueous solutions of sodium hydroxide in a concentration of 0.2%, 1.0% and 5.0% by weight.

Example 20

Example 18 was repeated except that hot alkali treatment was carried out at 130° C. for 120 minutes using aqueous solutions of sodium hydroxide in a concentration of 0.2%, 1.0% and 5.0% by weight.

Comparative Examples 12–13

In Comparative Example 12, a fabric as used in Example 18 which was subjected to bleaching, but not liquid ammonia treatment was subjected to hot alkali treatment. In Comparative Example 13, a fabric as used in Example 18 which was subjected to bleaching and mercerization instead of liquid ammonia treatment was subjected to hot alkali treatment.

The hot alkali treatment was carried out at 130° C. for 120 minutes using aqueous solutions of sodium hydroxide in a concentration of 0.2%, 1.0% and 5.0% by weight.

The fabrics obtained in Examples 18 to 20 and Comparative Examples 12 and 13 were subjected to a washing test (JIS L-217 103 method) involving 10 cycles of washing. The fabrics were visually observed to examine whether creases were maintained, with rating made according to the following criterion. The results are shown in Tables 5 and 6.

TABLE 5

| | | E18 | | | E19 | | | E20 | | |
|---|---|---|---|---|---|---|---|---|---|---|
| Fabric used | | liquid ammonia treatment | | | liquid ammonia treatment | | | liquid ammonia treatment | | |
| Alkali treatment | | 130° C. × 30 min. | | | 130° C. × 60 min. | | | 130° C. × 120 min. | | |
| NaOH concentration (wt %) | | 0.2 | 1.0 | 5.0 | 0.2 | 1.0 | 5.0 | 0.2 | 1.0 | 5.0 |
| Durability against washing (103 method, tumble) | 1 cycle | 6 | 6 | 6 | 6 | 6 | 6 | 6 | 6 | 6 |
| | 5 cycles | 5 | 5 | 6 | 5 | 5 | 6 | 5 | 6 | 6 |
| | 10 cycles | 5 | 5 | 6 | 5 | 5 | 6 | 5 | 6 | 6 |

Crease rating
6: after washing, acute creases are maintained substantially the same as before washing
5: after washing, creases are maintained acute, but somewhat less acute than 6
4: after washing, creases are maintained, but less acute than 5
3: after washing, creases are maintained, but less acute than 4
2: after washing, dull creases are left
1: after washing, few creases are left

TABLE 6

| | | CE12 | | | CE13 | | |
|---|---|---|---|---|---|---|---|
| Fabric used | | not treated | | | mercerized | | |
| Alkali treatment | | 130° C. × 120 min. | | | 130° C. × 120 min. | | |
| NaOH concentration (wt %) | | 0.2 | 1.0 | 5.0 | 0.2 | 1.0 | 5.0 |
| Durability against washing (103 method, tumble) | 1 cycle | 4 | 5 | 5 | 5 | 5 | 6 |
| | 5 cycles | 1 | 1 | 2 | 3 | 3 | 4 |
| | 10 cycles | 1 | 1 | 2 | 1 | 3 | 4 |

Equivalent results were obtained with knitted fabrics.

Example 21

A plain woven fabric of 20-count single yarn 100% cotton was conventionally bleached and mercerized, dipped in liquid ammonia at a temperature of −34° C. for 10 seconds, and heated for evaporating off ammonia. Using the system shown in FIGS. 1 to 3, the fabric was subjected to treatment with caustic soda aqueous solution, creasing, and neutralizing/washing.

In the mangle padder 1, an aqueous solution of sodium hydroxide in a concentration of 24% by weight at a temperature of 25° C. was applied to the fabric in a coverage of 50% by weight based on the weight of the fabric. Then in the creasing machine 2, the fabric F was bundled into a rope through the ring 5, given an appropriate tension through the swivel tension bar 7, and guided to a roller section including six pairs of rubber rollers 8 having a diameter of 20 cm and a width of 30 cm. The pneumatic cylinder 9 applied a force of about 100 to 300 kg to a pair of opposed rubber rollers 8 to place them in pressure contact for compressing the rope of fabric. As best shown in FIG. 3, the textile F was once compressed between the rubber rollers 8, passed one round around the lower rubber roller 8, and compressed again between the rollers 8 whereby numerous longitudinal creases were imparted to the textile. The creasy textile was introduced into the neutralizing/washing machine 3 after 60 seconds from the end of creasing step. The textile is then washed with water and dried.

Example 22

Example 21 was repeated except that an aqueous solution of sodium hydroxide was locally applied to the fabric by means of a printing machine rather than applying an aqueous solution of sodium hydroxide to the entire surface of the fabric by means of a mangle padder.

Example 23

Example 21 was repeated except that the fabric was dyed or printed prior to application of an aqueous solution of sodium hydroxide.

Example 24

Example 22 was repeated except that the fabric was dyed or printed prior to application of an aqueous solution of sodium hydroxide.

Comparative Example 14

Example 21 was repeated except that the liquid ammonia treatment was omitted.

The fabrics obtained in Examples 21 to 24 and Comparative Example 14 were subjected to a washing test (JIS L-217 103 method) involving 10 cycles of washing. The fabrics were visually observed to examine whether creases were maintained, with rating made according to the same criterion as in Example 18. The results are shown in Table 7.

TABLE 7

| | E21 | E22 | E23 | E24 | CE14 |
|---|---|---|---|---|---|
| Before washing | 6 | 6 | 6 | 6 | 6 |
| 10 cycles of washing | 6 | 6 | 6 | 6 | 1–3 |

Equivalent results were obtained with knitted fabrics.

According to the invention, durable creases can be formed in a cellulosic fiber textile simply by carrying out hot water treatment or alkali treatment immediately before, during or immediately after creasing. In the case of hot water treatment, durable creases can be formed in dyed or printed fiber textiles without discoloration and a loss of fastness.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for forming durable creases in a cellulosic fiber textile, comprising the steps of:

treating the fiber textile with liquid ammonia, creasing the fiber textile, and subjecting the fiber textile to hot water or alkali treatment substantially simultaneous with or subsequent to the creasing step.

2. The method of claim 1 wherein the hot water treatment is carried out in hot water at 100 to 150° C. for 10 minutes to 5 hours.

3. The method of claim 1 further comprising the step of dyeing or printing the fiber textile prior to the creasing step.

4. The method of claim 1 wherein the alkali treatment is carried out in an aqueous solution having an alkali concentration of 0.1 to 10% by weight at 100 to 150° C. for 10 minutes to 5 hours.

5. The method of claim 1 wherein the alkali treatment is carried out in an aqueous solution having an alkali concentration of 10 to 40% by weight at −10° C. to 90° C.

6. The method of claim 5 wherein the creasing step is carried out within 60 seconds after application of the alkaline solution to the fiber textile.

7. The method of claim 5 further comprising the step of neutralizing and water washing the fiber textile after at least 20 seconds from the creasing step.

* * * * *